US007518478B2

(12) United States Patent
Habboosh

(10) Patent No.: US 7,518,478 B2
(45) **Date of Patent: *Apr. 14, 2009**

(54) MOUNTING BRACKET FOR A SECURITY DEVICE

(75) Inventor: Samir W. Habboosh, Hamden, CT (US)

(73) Assignee: Harco Laboratories, Inc., Branford, CT (US)

( * ) Notice: Subject to any disclaimer, the term of this patent is extended or adjusted under 35 U.S.C. 154(b) by 126 days.

This patent is subject to a terminal disclaimer.

(21) Appl. No.: 11/614,614

(22) Filed: Dec. 21, 2006

(65) Prior Publication Data

US 2007/0152784 A1 Jul. 5, 2007

Related U.S. Application Data

(63) Continuation of application No. 11/400,705, filed on Apr. 7, 2006, now Pat. No. 7,187,259, which is a continuation-in-part of application No. 11/317,117, filed on Dec. 22, 2005, now Pat. No. 7,248,136, which is a continuation-in-part of application No. 11/203,497, filed on Aug. 12, 2005, now Pat. No. 7,218,194.

(51) Int. Cl.
*H01H 9/00* (2006.01)
*G08B 13/08* (2006.01)

(52) U.S. Cl. ..... 335/205; 340/547

(58) Field of Classification Search ..... 335/151–154, 335/205–207; 340/547–551
See application file for complete search history.

(56) References Cited

U.S. PATENT DOCUMENTS

| | | | | |
|---|---|---|---|---|
| 4,210,889 | A | 7/1980 | Holce | 335/207 |
| 4,287,512 | A | 9/1981 | Combs | 340/542 |
| 4,651,138 | A | 3/1987 | Morrison | 340/510 |
| 4,897,049 | A | 1/1990 | Miller et al. | 439/365 |
| 4,945,340 | A | 7/1990 | Brill | 340/547 |
| 5,233,323 | A | 8/1993 | Burkett et al. | 335/207 |
| 5,305,728 | A | 4/1994 | Young et al. | 124/87 |
| 5,332,992 | A | 7/1994 | Woods | 340/547 |
| 5,530,428 | A | 6/1996 | Woods | 340/547 |
| 5,576,678 | A * | 11/1996 | Saunders | 335/205 |
| 5,633,626 | A | 5/1997 | Cawthorne | 340/545.1 |
| 5,668,533 | A | 9/1997 | Jackson, Jr. et al. | 340/547 |
| 5,673,021 | A | 9/1997 | Woods | 340/547 |
| 5,877,664 | A | 3/1999 | Jackson, Jr. | 335/205 |
| 5,880,659 | A | 3/1999 | Woods | 335/207 |
| 5,997,873 | A | 12/1999 | Srivastava | 424/193.1 |
| 6,506,987 | B1 | 1/2003 | Woods | 200/61.62 |
| 6,603,378 | B1 | 8/2003 | Collins | 335/205 |
| 6,803,845 | B2 | 10/2004 | Woods | 335/207 |
| 2003/0052780 | A1 | 3/2003 | Buckely | 340/547 |
| 2004/0160321 | A1 * | 8/2004 | Hoblack | 340/547 |

OTHER PUBLICATIONS

Spec sheet for Sentrol 2707 I Mounting Bracket, no date.
Spec sheet for Sentrol 2707 Z Mounting Bracket, no date.

* cited by examiner

*Primary Examiner*—Ramon M Barrera
(74) *Attorney, Agent, or Firm*—St. Onge Steward Johnston & Reens LLC

(57) ABSTRACT

A universal magnetic switching assembly for detecting relative movement between first and second members, the universal switching assembly mounted on a bracket that may be used to adjust the positioning of the magnetic components relative to each other on opposing members to maintain the operational gap between the opposing magnetic components.

18 Claims, 16 Drawing Sheets

MOUNTING BRACKET FOR A SECURITY DEVICE

CROSS-REFERENCE TO RELATED APPLICATIONS

This application is a continuation of U.S. patent application Ser. No. 11/400,705 filed Apr. 7, 2006, now U.S. Pat. No. 7,187,259 which is a continuation-in-part of U.S. patent application Ser. No. 11/317,117 filed Dec. 22, 2005, now U.S. Pat. No. 7,248,136 which is a continuation-in-part of U.S. patent application Ser. No. 11/203,497 filed Aug. 12, 2005 now U.S. Pat. No. 7,218,194.

FIELD OF THE INVENTION

The present invention is directed toward a mounting bracket that may be used in connection with magnetic switches used as part of alarm systems to detect relative movement between a first and a second member such as a door and doorframe. More specifically, the present invention provides an improved mounting bracket, which may be used to adjust the relative positioning of the magnetic components.

BACKGROUND OF THE INVENTION

Security alarm systems often use magnetic switches attached to doors and windows for detecting unauthorized openings. One type of magnetic switch utilized is a reed switch. However, these switches are subject to unauthorized manipulation through use of, for example, an external magnet. Specifically, a compact high energy magnet may be positioned in proximity to the reed switch, which will then be operated (to either open or close depending on the control scheme). Once accomplished, an intruder may open the door or window without triggering the alarm system.

A number of magnetic switches have been proposed in the past to overcome the inherent limitation and serious deficiencies of reed switches including, U.S. Pat. Nos. 5,997,873; 5,530,428; 5,332,992; 5,673,021; 5,880,659; and 6,506,987. These switches typically include a pair of spaced apart switch elements with a shiftable body (e.g., a spherical ball) movable between a first position where the ball is in simultaneous contact with both switch elements and a second position out of simultaneous contact with the switch elements. An alarm circuit may be electrically coupled to the switch elements so as to detect movement of the body. However, these switches may still be manipulated by an externally applied magnetic force.

Other systems have been presented that also offer limited protection from external magnetic manipulation including, U.S. Pat. Nos. 6,506,987; 6,603,378; and 6,803,845. While the switch arrangements in these patents represent an improvement in the field, these switch arrangements suffer from some inherent problems. For example, while offering a degree of security against external magnetic fields in one plane, these switches may still be defeated by introducing an external magnetic force in one of several or in multiple planes. Another problem presented by these switches is that they are prone to misalignment, causing problems with accurate functioning of the system. In addition, these switches may be highly sensitive to the material to which they are mounted. For example, if these switches are mounted to a steel base, a portion of the magnetic field strength may be drawn away negatively affecting system performance.

Another system is disclosed in U.S. Pat. No. 5,877,664 entitled Magnetic Proximity Switch System. This system teaches use of an armature member that may be shifted to various positions to electrically open or close various contacts depending upon the position of a magnet. For example, when a first magnet is in a first position, the armature member resides in a first position. But when the first magnet is moved to a second position, the armature member may then be drawn to a second position by a second magnet. The '664 patent further teaches that at least two switch pole pieces may be used in conjunction with each other to provide off switch axis actuation or actuation though surfaces not normal to the axis of the switch. However, a problem with the '664 patent is that, the device cannot tolerate fields off axis leading to operational problems. Without a pole piece, flux leakage could result in off axis leakage disadvantageously affecting the performance of the switch. To compensate for this, the '664 patent provides at least two pole pieces to redirect the magnetic flux. This disadvantageously requires increased space and hardware to accomplish.

Another problem with the '664 patent is that there is no way to control the amount of magnetic flux that is applied to a switch. Rather, the '664 patent is designed merely to maximize magnetic flux to the device when transmitted off axis. Accordingly, there is no way to generate or maintain a particular field strength at the switch.

Still another problem with the '664 patent is that there is no way to channel magnetic flux applied to the pole piece in different directions to, for example, multiple switches. Rather, to change the direction of the magnetic field, the '664 patent teaches that at least two pole pieces are required to accomplish this. In fact, only one cross-sectional area provides the active surface for the pole piece. Again this leads to increased space requirements, additional materials and expense.

Finally, due to the configuration of system taught in the '664 patent with the at least two pole pieces, the system is prone to misalignment problems. While the at least two pole pieces are used to channel off axis magnetic flux, they do not address the problems created caused by misalignment and must be positioned relatively close to each other to function properly.

Misalignment can cause magnetic systems to malfunction. For example, the magnetic field that transfers from one piece to another across an operational air gap (e.g. the door jam) must be kept in relative close proximity to each other. The various pieces of the magnetic system may be installed correctly, however, over time the door may sag thereby increasing the distance and causing misalignment of the various pieces, which may adversely affect the performance of the system.

What is desired then, is a system and method that will provide an improved magnetic switching device that is essentially undefeatable by application of an externally applied magnetic field.

It is further desired to provide a system and method that provides an improved magnetic switching device that may not be defeated with the application of an external magnetic field in one of several or multiple planes.

It is still further desired to provide a system and method that provides an improved magnetic switching device that reduces sensitivity to system misalignment.

It is yet further desired to provide a system and method that provides an improved magnetic switching device that is relatively insensitive to the material to which they are mounted.

It is also desired to provide a system and method for controlling the magnetic flux intensity that may be applied to a switch component.

It is still further desired to provide a system and method that gathers and channels magnetic flux to several or in multiple directions for application to various switches.

It is yet further desired to provide a system and method that may be used to increase the total amount of magnetic flux applied to a switch component.

It is still further desired to provide a system and method for variably adjusting the positions of the various pieces used in a magnetic switching arrangement to compensate for movement of the members upon which the pieces are affixed.

SUMMARY OF THE INVENTION

These and other objects are achieved by the provision of an improved magnetic switching arrangement that detects relative movement between first and second members such as doors/door frames and are typically used to detect when one of the members is moved from a first position in close proximity with the second member, to a second position where the one member is moved to a remote position.

The switch arrangement includes, a switch assembly, for mounting to the first member, the switch assembly having first and second switch elements in spaced relationship to each other, an electrically conductive body shiftable between a first position where the body is in simultaneous contact with both of the switch elements, and a second position where the body is not in contact with both of the switch elements. The switch assembly further includes a first magnetically attractive component adjacent the contacts in the first structural member and a second magnetically attractive component for mounting to the second member. The first and second attractive components are selected and located so that, when the first and second structural members are in the first, adjacent position, the body will be shifted to a position out of simultaneous contact with said first and second switch elements by virtue of a magnetic attraction between the body and the second attractive component. When the first and second members are in the second, remote position, the body will be shifted to a position into simultaneous contact with both of said switch elements by virtue of a magnetic attraction between the body and the first attractive component.

It is understood that over time, the first member may move relative to the second member. For example, when the first and second members comprise a door and door jam, over time the door may sag. This sagging of the door relative to the frame disadvantageously causes the distance between the first and second switch elements to increase. Accordingly, in another advantageous embodiment, a mounting bracket is provided that allows for variable adjustment of the distance between the first and second switch elements.

In one advantageous embodiment, the mounting bracket comprises a substantially flat body portion for one of the first or the second switch elements to be mounted upon. The substantially flat body portion may be used in application where the door is substantially flush with the door frame. Typically the actuator section will utilize the mounting bracket, while the switch assembly portion may utilize a spacer of generally equivalent thickness to align the portions when install on the door. It is contemplated that if the door is misaligned in this axis, the spacer may not be required.

The mounting bracket may be provided with mounting holes provided therein for one of the switch elements to be securely attached thereto by, for example, screws or bolts. In one advantageous embodiment, the mounting bracket is provided with four mounting holes, but may be provided with substantially any number as desired. In an alternative embodiment, mounting studs are provided on the mounting bracket to engage with one of the switch elements. In one advantageous embodiment, the mounting bracket is provided with four mounting studs, but may be provided with virtually any number as desired.

The mounting bracket is further provided with at least two elongated substantially parallel slots (but may contain, for example, four or more elongated slots as desired), which are provided to engage with mounting elements engaging with, for example, either the first or second member. When one of the switch elements is to be mounted to for example, a door, the mounting bracket may be affixed to the door by means of mounting elements, which may comprise mounting screws. The mounting bracket is positioned on the door such that the slots extend substantially perpendicular to the floor. In this manner, if the door sags over time thereby increasing the distance between the first and second switch elements, a user need only loosen the mounting element engaging with the slots and raise the entire mounting bracket relative to the floor to correspondingly decrease the distance between the first and second switch elements. In this manner, any misalignment of the first and second switch elements may be compensated for by a simple adjustment or set for minimum gap.

It is contemplated that the shiftable switch body may be permanently magnetized and the first and second attractive components may be complementary magnets or formed of steel or other magnetically susceptible material. Alternately, the first and second attractive components may be permanently magnetic whereas the shiftable body is formed of steel or other material, which is magnetically attractive to the components.

The improved magnetic switching arrangement further comprises in one advantageous embodiment, a magnetic flux director or concentrator. The director provides a reduced or lower reluctance path for an applied magnetic field thereby acting to "absorb" these fields from the surrounding space. The lower reluctance path operates to increase any magnetic fields applied to the flux directing device. These fields then leave the director in regions of varying flux density around its space as a consequence of the material composition and design of the device. In this manner, the magnetic field strength applied to the switch(es) may effectively controlled by material selection and design of the flux directing device. The fields emanate from the surfaces of the director with varying but relatively uniform energy levels. This field couples to the surrounding switches and/or bias rings within their narrow actuation angle thereby creating localized balanced magnetic circuits. When the circuit is unbalanced due to the movement of the actuator or the introduction of an externally applied field the switch(es) change state.

For example, the second attractive component may be provided as a relatively large permanent magnet that overcomes the attractive force of the relatively small first attractive component. The flux director acts to control the amount of magnetic flux applied to the shiftable switch body. For example, the flux director may be used to increase the total magnetic field strength applied to the flux director, but also may be used to channel a relatively large amount of the field strength away from the shiftable body to, for example, other devices. In this manner, while the total magnetic field strength may be increased, the amount applied to the shiftable body may actually have been decreased, but there is still sufficient magnetic flux that reaches the shiftable switch body to overcome the attractive force of the first attractive component. Therefore, in order to defeat the switch system by maintaining the shiftable switch body in the first position while moving the second magnetic component away from the shiftable switch body (i.e. opening the door); one would have to use a relatively large magnet that produces a magnetic field at least as strong as the second attractive component. This however, cannot be accomplished for a number of reasons. First, the relative spacing between the first and second members is relatively small, e.g. the door and doorframe are provided with a relatively close fit. In this manner, a potential intruder is prevented from inserting the relatively large and bulky magnet required to shift the switch body due to the flux director, between the first and second members (e.g. between the door and doorframe). While a very low profile magnet and therefore a relatively weak magnet may be inserted, this will not prevent the shiftable switch body from moving to the second position thereby indicating that the door has been opened.

A second reason it that if the potential intruder were to position the relatively large and powerful magnet on the surface of one of the members in order to actuate the switch body, a tamper switch will be actuated causing an alarm condition. Multiple tamper switches may be positioned to actuate upon the application of a magnetic field in virtually any plane in which the magnetic field component is located. Therefore, magnetic flux may only be applied in one plane from the outside of the device; however, again the spacing provided is relatively small thereby preventing a potential intruder from defeating the switching system. The presence of a relatively large drive magnet makes it very difficult to place a defeat magnet in the plane of operation. The relatively high field strength of the drive magnet will likely attract the defeat magnet and dislodge it from the defeat actuation surface.

The provision of the flux director also minimizes the problem of misalignment associated with prior art devices. This is because the flux director has a tendency to gather in and channel any attractive force directed at the flux director. Additionally, the flux director helps to desensitize the switching device to the composition of the mounting surface due to the fact that magnetic flux is gathered and concentrated within a relatively narrow angle for actuation of the shiftable body. This means that, even if the overall magnetic field strength is affected, for example, reduced due to the mounting material composition, such as steel, the system will continue function properly because the magnetic field encounters the relatively low reluctance path of the flux director and is directed and/or concentrated based on the design of the flux director.

Also provided in the improved magnetic switching arrangement in another advantageous embodiment is a return flux director, which may be used to gather return magnetic flux and direct it back to the second attractive component. This further reduces and/or eliminates the problems associated with misalignment and further desensitizes the arrangement to the composition of the members. It should be noted that either the flux director or the return flux director or both may effectively be utilized as desired.

Still further provided in another advantageous embodiment are various biasing rings that are positioned to encircle the shiftable switch body to provide for increased repeatability of the switching device. The biasing rings are provided to ensure that the switch body will actuate at substantially identical applied signal levels. It is also contemplated that multiple shiftable bodies (e.g. main and auxiliary switch contact arrangements) may effectively be utilized in connection with the flux director. The location of the biasing rings may further be varied depending upon the location of the multiple magnetic switches. Additionally, multiple attractive components may effectively be utilized to further increase system performance and repeatability. It is further contemplated that, for example, permanent magnets may also be used as biasing means, or even a combination of permanent magnets and biasing rings.

Accordingly, in one advantageous embodiment, a magnetic switching device for detecting relative movement between a first and a second member is provided comprising, a switch assembly for mounting to the first member. In this embodiment the switch assembly includes, a first switch element and a second switch element, the second switch element positioned apart from the first switch element, an electrically conductive shiftable body, a first attractive component, and a flux director positioned in proximity to the shiftable body. The shiftable body is provided such that it is movable between a first position where the shiftable body is in simultaneous contact with the first and second switch elements, and a second position where the shiftable body is out of simultaneous contact with the first and second switch elements. The magnetic switching device further comprises a second attractive component for mounting to the second member. The director provides a lower reluctance path for an applied magnetic field thereby acting to "absorb" these fields from the surrounding space. The magnetic fields emanating from the director couples to the surrounding switches and/or bias rings, which when used comprise the first attractive component within their narrow actuation angle. In addition, the first and second attractive components are positioned such that when the first and second members are in proximity to each other in a proximal position, the magnetic flux directing device allows a threshold level of magnetic flux to be applied to the shiftable body so that the shiftable body is moved to one of the first or second positions, and when the first and second members are moved out of proximity to each other in a distal position, the shiftable body is moved to the other of the first or second positions.

In another advantageous embodiment a magnetic switching device for detecting relative movement between a first and a second member is provided comprising, a switch assembly that has an electrically conductive shiftable body that shifts between simultaneous contact with two switch elements and non-simultaneous contact with the two switch elements based upon applied magnetic fields generated by first and second attractive components. In this advantageous embodiment the switch assembly further includes a flux director positioned in proximity with the shiftable body. The director provides a lower reluctance path for an applied magnetic field thereby acting to "absorb" these fields from the surrounding space. The magnetic fields emanating from the director couples to the surrounding switches and/or bias rings, which when used comprise the first attractive component within their narrow actuation angle. In addition, the first and second attractive components are positioned such that when the first and second members are in proximity to each other in a proximal position, the magnetic flux directing device allows a threshold level of magnetic flux to be applied to the shiftable body so that the shiftable body is moved to one of the first or second positions, and when the first and second members are moved out of proximity to each other in a distal position, the shiftable body is moved to the other of the first or second positions.

In still another advantageous embodiment, a magnetic switching device for detecting relative movement between a first and a second member and for sending a signal indicative of the relative movement to a control panel is provided comprising, a switch assembly that has an electrically conductive shiftable body that shifts between simultaneous contact with two switch elements and non-simultaneous contact with the two switch elements based upon applied magnetic fields generated by first and second attractive components. The switch assembly further including, the first and second attractive components being positioned such that when the first and second members are in proximity to each other in a proximal position, the magnetic flux directing device allows a threshold level of magnetic flux to be applied to the shiftable body so that the shiftable body is moved to one of the first or second positions, and when the first and second members are moved out of proximity to each other in a distal position, the shiftable body is moved to the other of the first or second positions. The magnetic switching device further comprises, a resistor network positioned in the magnetic switching device for sending, via a set of control leads, a signal indicative of the relative movement between a first and a second member to the control panel.

In yet another advantageous embodiment a magnetic switching device is provided for detecting relative movement between a first and a second member comprising, a switch assembly that has an electrically conductive shiftable body that shifts between simultaneous contact with two switch elements and non-simultaneous contact with the two switch elements based upon applied magnetic fields generated by first and second magnetic components. The switch assembly further includes, a flux concentrator positioned in proximity with the shiftable body. The switch assembly is provided such that the flux concentrator provides a reduced reluctance path for an applied magnetic field such that the strength of the applied magnetic field is increased, and the flux concentrator directs at least a portion of a magnetic field emanating therefrom toward the switch assembly. The switching device is provided such that the first and second magnetic components are positioned so that when the first and second members are in proximity to each other, the flux concentrator directs magnetic flux to the shiftable body so that the shiftable body is moved to one of the first or second positions, and when the first and second members are moved out of proximity to each other, the shiftable body is moved to the other of the first or second positions.

In still another advantageous embodiment a magnetic switching device is provided for detecting relative movement between a first and a second member and for sending a signal indicative of the relative movement to a control panel comprising, a switch assembly that has an electrically conductive shiftable body that shifts between simultaneous contact with two switch elements and non-simultaneous contact with the two switch elements, which is based upon applied magnetic fields generated by first and second magnetic components. The switch assembly further includes a flux concentrator positioned in proximity with the shiftable body that directs at least a portion of a magnetic field emanating therefrom toward the switch assembly. The switching device is provided such that the first and second magnetic components are positioned so that when the first and second members are in proximity to each other, the flux concentrator directs magnetic flux to the shiftable body so that the shiftable body is moved to one of the first or second positions, and when the first and second members are moved out of proximity to each other, the shiftable body is moved to the other of the first or second positions. The switching device further comprises a resistor network positioned in the magnetic switching device for sending, via a set of control leads, a signal indicative of the relative movement between a first and a second member to the control panel.

In yet another advantageous embodiment a magnetic switching device for detecting relative movement between a first and a second member is provided, comprising, a first switch that has an electrically conductive shiftable body that shifts between simultaneous contact with two switch elements and non-simultaneous contact with the two switch elements based upon applied magnetic fields. The switching device further comprises, a second switch that has an electrically conductive shiftable body that shifts between simultaneous contact with two switch elements and non-simultaneous contact with the two switch elements based upon applied magnetic fields. The switching device still further comprises, a flux director, positioned in proximity with the first and second switches, the flux director channeling at least a portion of an applied magnetic field toward the first switch and at least a portion of an applied magnetic field toward the second switch.

In still another advantageous embodiment, a magnetic switching system for detecting relative movement between a first and a second member is provided. The switch device comprises a first part coupled to the first member including a switch having an electrically conductive shiftable body that shifts between simultaneous contact with two switch elements and non-simultaneous contact with the two switch elements based upon an applied magnetic field. The switch device further comprises a second part coupled to the second member including a magnetic component to generate the applied magnetic field, the first and second parts spaced apart from each other by an operational gap. The switch device still further comprises a bracket affixed to the first member, the bracket having a substantially flat body including a mounting element receiving said first part thereon, the bracket further including at least two substantially parallel slots extending through the substantially flat body, the slots extending perpendicular to the operational gap such that the size of the operational gap may be adjusted.

In yet another advantageous embodiment, a magnetic switching system for detecting relative movement between a first and a second member is provided. The switch device comprises a first part coupled to the first member including a switch having an electrically conductive shiftable body that shifts between simultaneous contact with two switch elements and non-simultaneous contact with the two switch elements based upon an applied magnetic field. The first part includes a flux concentrator positioned in proximity with the shiftable body, the flux concentrator providing a reduced reluctance path for the applied magnetic field such that the strength of the applied magnetic field is increased and the flux concentrator directing at least a portion of a magnetic field emanating therefrom toward the switch. The switch device further comprises a second part coupled to the second member including a magnetic component to generate the applied magnetic field, the first and second parts spaced apart from each other by an operational gap. The switch device still further comprises a bracket affixed to the first member, the bracket having a substantially flat body including a mounting element receiving the first part thereon, the bracket further including two substantially parallel slots extending through the substantially flat body, the slots extending perpendicular to the operational gap such that the size of the operational gap may be adjusted.

In still another advantageous embodiment, a bracket for mounting a first part of a magnetic switching system to a first member, the first part spaced apart from a second part that is attached to a second member over an operational gap is provided. The bracket comprises a substantially flat body having a substantially rectangular shape and a mounting element for attaching the first part to the substantially flat body portion. The mounting element may comprise mounting holes located in the body or may including mounting studs positioned thereon. The bracket further comprises at least two substantially parallel slots extending through the substantially flat body portion, the slots extending perpendicular to the operational gap such that the size of the operational gap may be adjusted.

Other objects of the invention and its particular features and advantages will become more apparent from consideration of the following drawings and accompanying detailed description.

DETAILED DESCRIPTION OF THE INVENTION

Figure 1:
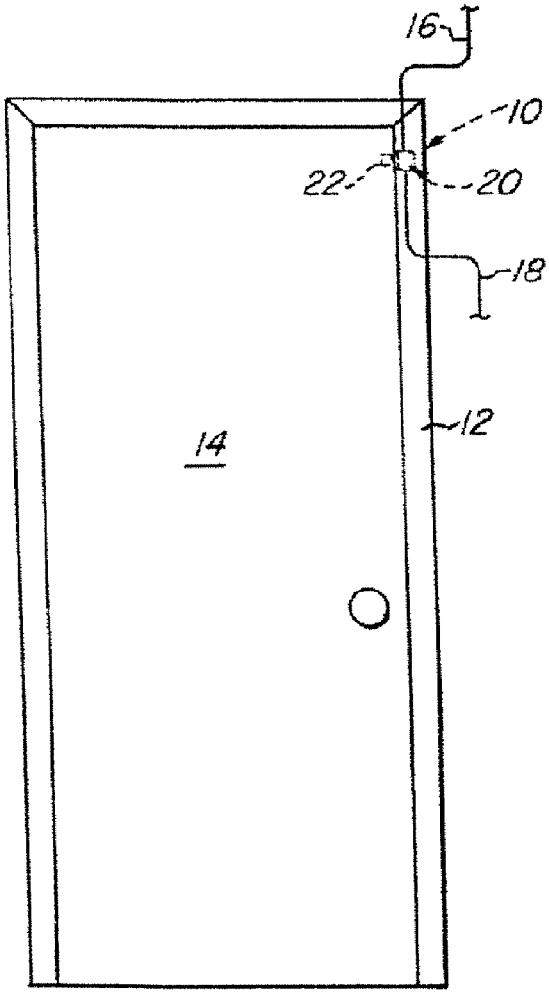
FIG. 1 illustrates a magnetic switch depicted in use for protecting a door.
Figure 2:
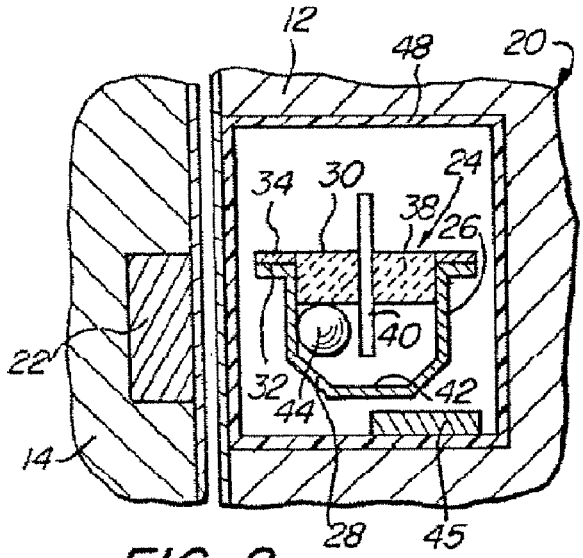
FIG. 2 depicts the construction and operation of the magnetic switch when the door is closed according to FIG. 1.

Turning now to the drawings, FIG. 1 illustrates a magnetic switch 10 (dashed lines) shown used with a doorframe 12 and door 14. Electrical leads 16, 18 are operatively coupled with the switch 10. While FIG. 2 illustrates a contact that is normally open when the door is in the secure position, it is contemplated that a normally closed contact when the door is in the secure position is equally applicable.

The switch 10 includes a switch assembly 20 secured to frame 12, as well as a second attractive component 22, which is mounted to door 14. The switch assembly 20 may include a housing 24 having a circumscribing annular sidewall 26, an integral concavo-convex bottom wall 28 and a top cover 30. Preferably, the integral sidewall and bottom wall 26, 28 presents a circumscribing flange 32 and is formed of a suitable non-magnetic, electrically conductive material, such as for instance, cupro-nickel alloy. The top cover 30 includes an outboard flange 34 adapted to mate with flange 32, and a central glass or ceramic nonconductive plug 38. The flange 34 may also be formed of a suitable non-magnetic, electrically conductive material.

The assembly 20 also includes an elongated substantially upright first switch element 40 which as shown extends downwardly through plug 38 to a point spaced above bottom wall 28, the latter having an annular contact surface 42 which serves as the second switch element.

A shiftable body 44 is located within housing 24 and is formed of electrically conductive material. Preferred configurations of body 44 include substantially spherical balls as well as cylinders but may take virtually any shape as desired.

The overall assembly 20 further includes a first attractive component 45 associated with housing 24. In the illustrated embodiment, the component 45 is situated slightly below housing 24 and is laterally offset relative to the central axis of the housing.

The top cover 30 is welded to sidewall 26 at the facing contact between the flanges 32 and 34, thereby creating a hermetically sealed internal chamber 46. In one advantageous embodiment, the chamber 46 may be filled with an inert gas such as for example, argon.

As illustrated, the housing 24 and first attractive component 45 may be located within a mounting box 48 positioned within an appropriately sized recess in frame 12. However, such a mounting arrangement is not required.

The second attractive component 22 is mounted to door 14, for example, near the top of the door. When the door 14 is closed relative to frame 12, it will be seen that the component 22 is directly in juxtaposition to housing 24. When the door 14 is opened, the component 22 is shifted away from the housing 24.

The materials used in fabricating the first and second attractive components 45, 22 and body 44 can be varied, so long as the operational principles of the switch 10 are maintained. For example, and in preferred forms, the body 44 may be formed of a permanently magnetized material. Suitable materials include an appropriate samarium-cobalt alloy with a thin (usually about 0.001-0.002") outer coating of nickel for wear purposes or neodynium iron boron. In such an instance, the attractive components 45 and 22 may be formed of steel (e.g., partially annealed steel) or of complementary magnetized material relative to the body 44. Alternately, the first and second components 45, 22 may be formed of permanently magnetized material while the body 44 is formed of any material, which is magnetically attracted to the first and second components. As explained in more detail hereafter, the goal in selecting the materials for the components 45 and 22 and body 44 is to assure that the body 44 may be appropriately magnetically shifted when the door 14 is moved between the closed and open positions thereof.

Specifically, and referring to FIG. 2, it will be seen that, when the door 14 is closed relative to frame 12, the body 44 is shifted laterally by virtue of a magnetic attraction between the second attractive component 22 and the body 44, so as to hold the body 44 in the FIG. 2 position out of simultaneous contact with the switch elements 40, 42. Of course, in this orientation, the magnetic attraction between component 22 and body 44 is greater than and overcomes the magnetic attraction between body 44 and first attractive component 45. The offset position of the component 45 augments this differential attraction relative to body 44.

Figure 3:
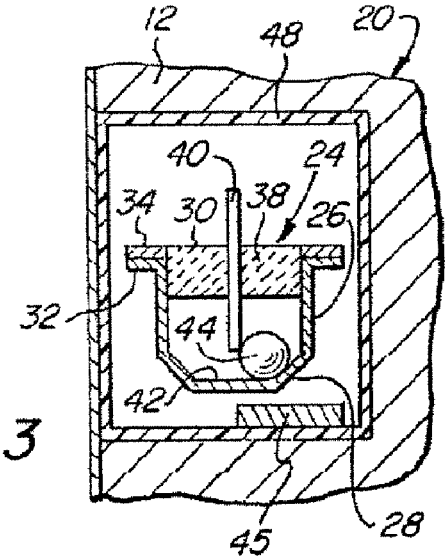
FIG. 3 is a sectional view similar to FIG. 2, but illustrating the operation of the magnetic switch when the door is open.

When the door 14 is open so that second attractive component 22 is remote from the switch assembly 20, the body 44 is magnetically shifted to the FIG. 3 position thereof, i.e., in simultaneous contact with the switch elements 40, 42. As will be readily understood, this shifting is effected because of the magnetic attraction between the body 44 and first attractive component 45.

The relative magnetic strengths or susceptibilities of the first and second components 45, 22 relative to body 44 must be considered in the design of switch 10. That is, the magnetic attraction generated between the body 44 and component 22 when the door 14 is closed must be significantly stronger than the countervailing magnetic attraction between the body 44 and the first component 45.

Figure 4:
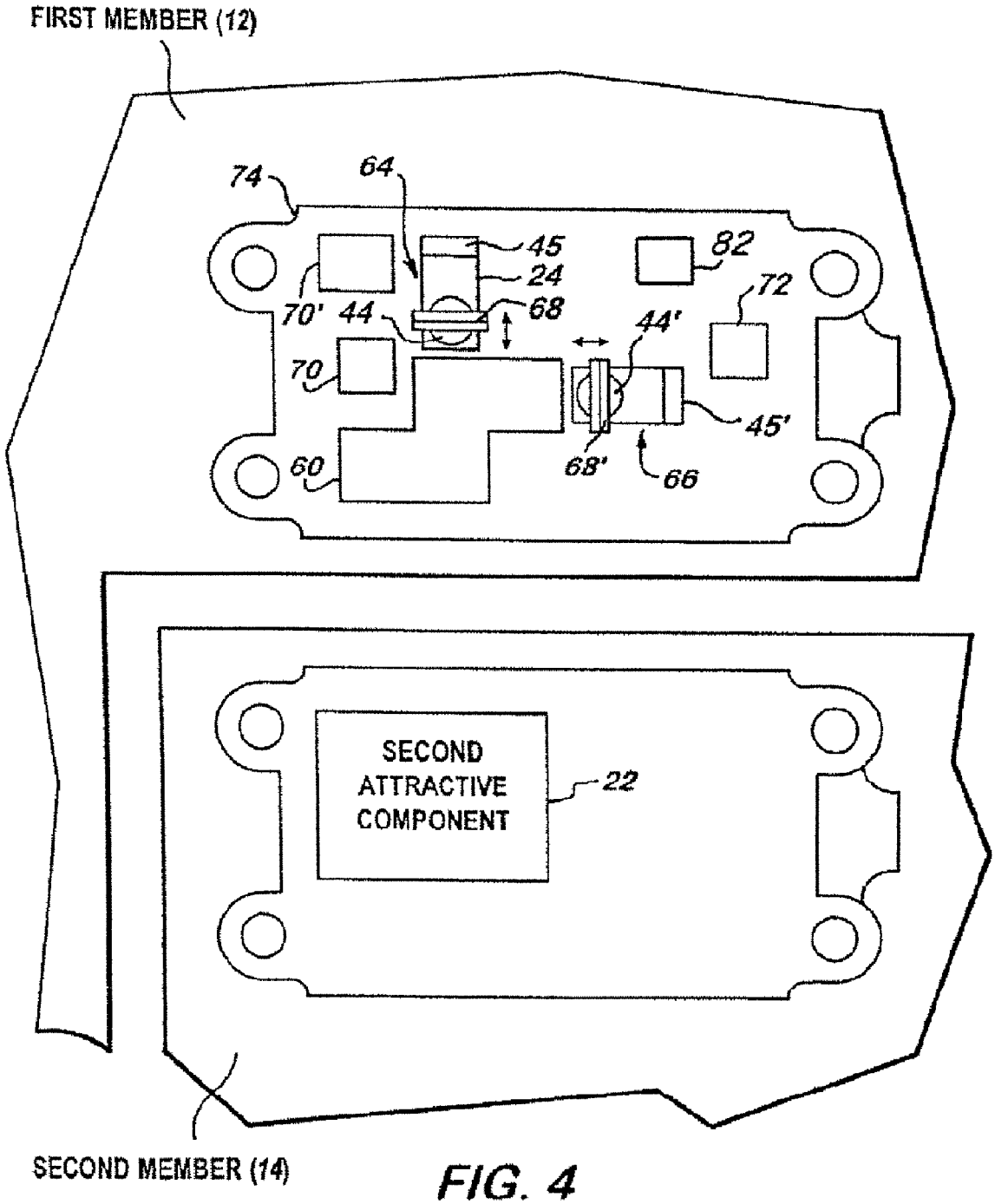
FIG. 4 is a block diagram of one advantageous embodiment of the present invention utilizing the magnetic switch according to FIG. 1.

Turning now to FIG. 4, an advantageous embodiment of the improved magnetic switching arrangement is illustrated. This configuration includes switch 10 and further includes flux director or concentrator 60.

Flux director 60 provides a lower reluctance path for an applied magnetic field thereby acting to "absorb" the field from second attractive component 22. The field leaves the director in regions of varying flux density around its space as a consequence of the material composition and design of the device. The field couples to, for example, body 44 (which may comprise a door contact or switch) within its relatively narrow actuation angle creating a localized balanced magnetic circuit. However, when the circuit is unbalanced due to movement of the actuator or the introduction of an externally applied field, body 44 changes state due to interaction with magnet 45 that comprises a first attractive component in this embodiment, indicating that for example, the door is open or the switch is being tampered with to generate an alarm condition. The presence of a large drive magnet makes it very difficult to place a defeat magnet in the plane of operation. The high field strength of the drive magnet will likely attract the defeat magnet and dislodge it from the defeat actuation surface. It is contemplated that additional door contacts or switches may be provided as desired.

Also illustrated in FIG. 4 is the internal resistor network 82, which will be discussed in greater detail in connection with FIG. 7. While the internal resistor network 82 is shown located with the components mounted to the first member 12, it is contemplated that the internal resistor network 82 may further be located with the components mounted to second member 14.

Figure 4A:
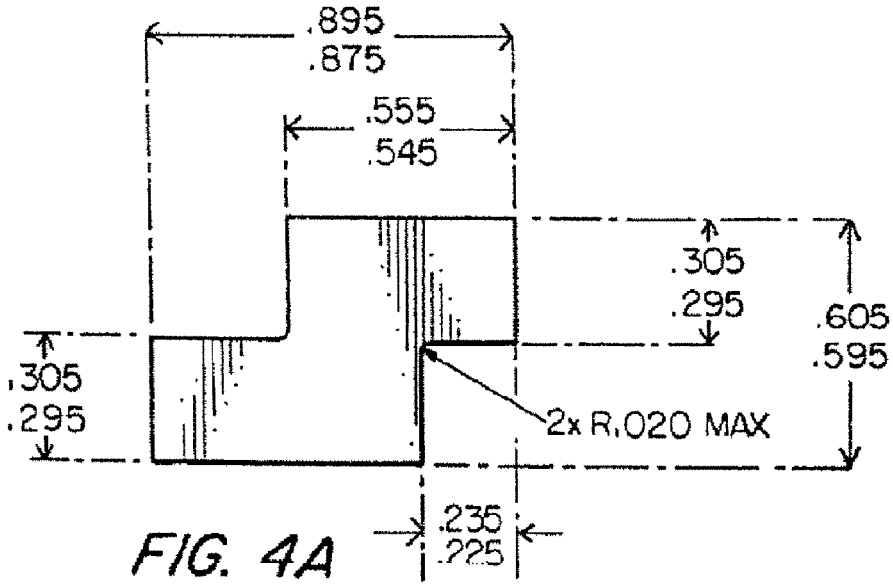
FIG. 4A is a side view showing the flux director according to FIG. 4.
Figure 4B:
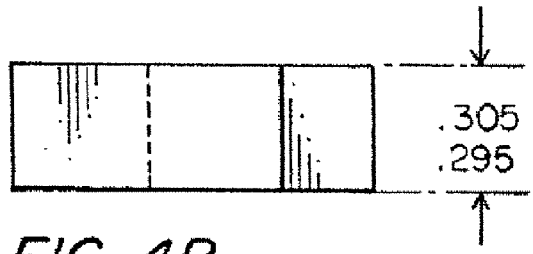
FIG. 4B is an edge view showing the flux director according to FIG. 4.

FIGS. 4A and 4B illustrate one advantageous embodiment of flux director 60 including preferable dimension ranges in inches. FIG. 4A illustrates a side view of flux director 60, while FIG. 4B shows a range of thickness measurements for flux director 60. It is contemplated that flux director 60, typically will comprise a ferrous material, but may comprise any magnetically permeable material including for example but not limited to, nickel.

Also shown in FIG. 4 is auxiliary switch 66, which is similar in operation to main switch 64. It should be noted that these switches (main switch 64, auxiliary switch 66, etc.) may be selected having any desired logic, whether normally open or normally closed and is should not be viewed as a limitation of the present invention. In one embodiment, auxiliary switch 66, includes body 44' and magnet 45', which comprises a first attractive component and may be used to switch a variety of system components as desired. Alternatively, both main switch 64 and auxiliary switch 66 may be provided with biasing rings 68, 68', which are positioned to surround body 44, 44' and comprise the first attractive components. One or more bias rings 68, 68' may be positioned around body 44, 44' as desired. Bias rings 68, 68' are provided to increase switching repeatability such that for an applied signal level or magnetic field strength, body 44, 44' will always actuate.

Figure 4C:
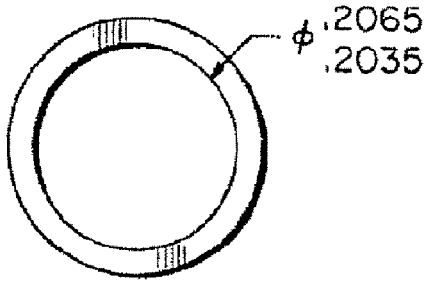
FIG. 4C is a end view showing the bias ring(s) according to FIG. 4.
Figure 4D:
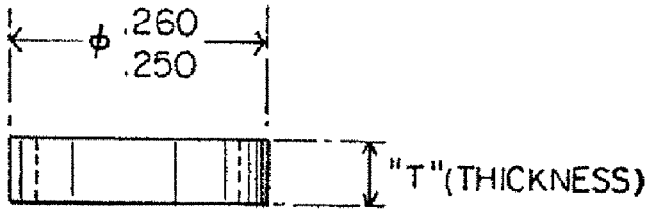
FIG. 4D is an edge view showing the bias ring(s) according to FIG. 4.

FIGS. 4C and 4C illustrate one advantageous embodiment for bias rings 68, 68' including preferable dimension ranges in inches. FIG. 4C depicts and view looking down the end of the bias ring with a preferable inside diameter (ID) provided. FIG. 4D is a side view of the bias ring providing both a preferable outside diameter (OD) measurement, and a measurement of the thickness (T) of the ring. The thickness (T) of the bias rings typically will range from about 0.01 inches to about 0.2 inches. It is contemplated that bias rings 68, 68' typically will comprise a highly permeable material, such as for example but not limited to, iron, nickel and/or combinations thereof. However, it should be noted that the biasing achieved by bias rings 68, 68' may further be achieved in another advantageous embodiment by use of a permanent magnet(s) or a combination of permeable material a permanent magnet(s) with bias rings 68, 68'.

Also provided is tamper switch 70, 70'. One or more tamper switches may be provided to indicate the application of an applied external magnetic field. If a potential intruder were to apply an external magnetic field to assembly 20 in a plane other than from the direction of the second attractive component 22, the applied external magnetic field would cause tamper switch(es) 70, 70' to actuate causing an alarm condition. It is contemplated that tamper switch(es) 70, 70' may further utilize the biasing means discussed above including, for example, the use of bias rings 68, 68', a permanent magnet (s) and/or a combination thereof.

Also provided in FIG. 4 is pry tamper switch 72, which will indicate whether assembly 20 has been moved relative to first member 12, also, providing an alarm upon activation.

It should be noted that for any of the magnetic switches utilized, for example, main switch 64, auxiliary switch 66, tamper switch(es) 70, 70', pry tamper switch 72, etc., the variously described biasing means may effectively be utilized, including, use of either bias rings 68, 68', or a permanent magnet(s) 45, 45' and/or a combination thereof for the various switches, which comprises the first attractive component.

Figure 5:
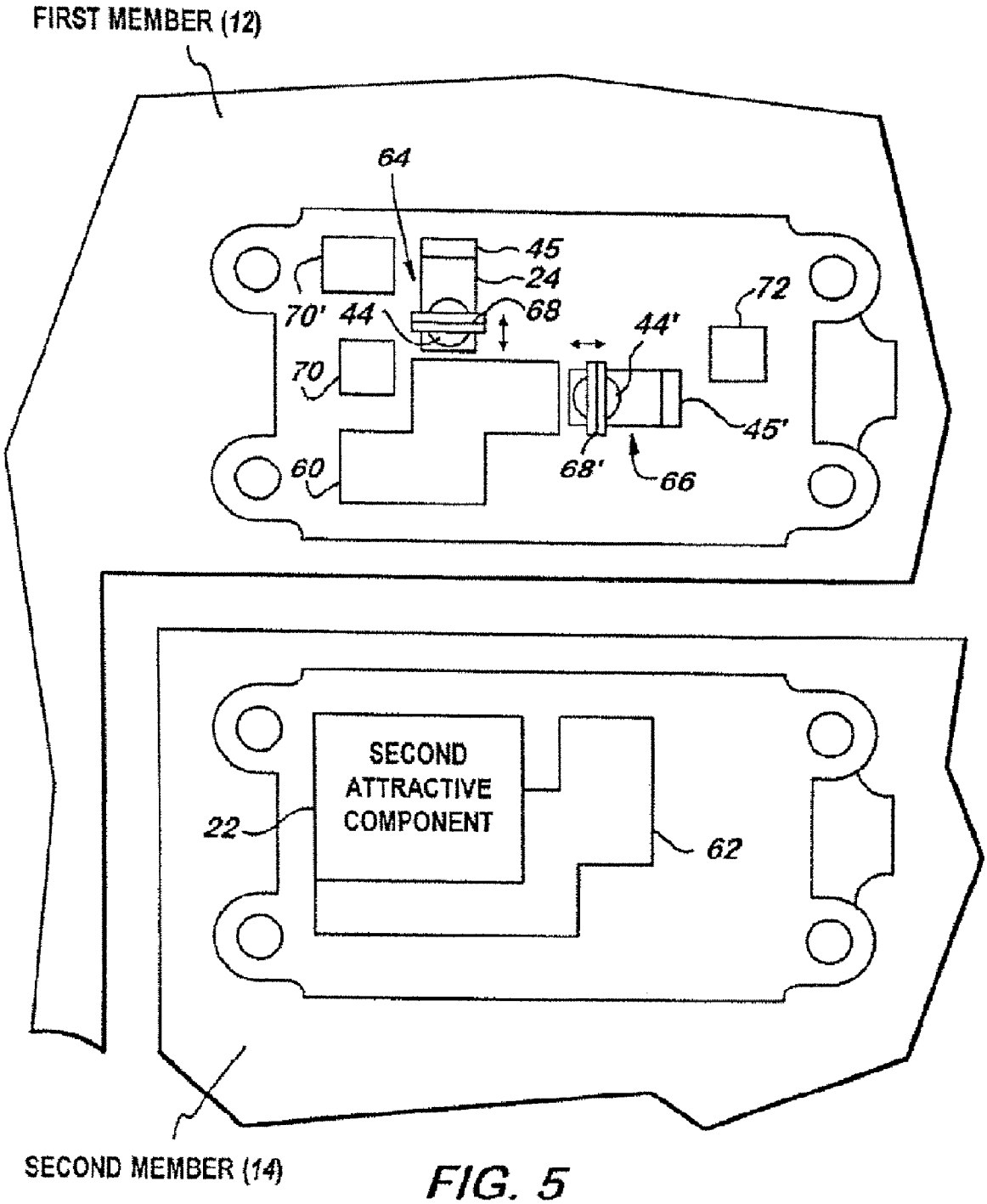
FIG. 5 is a block diagram of another advantageous embodiment of the present invention according to FIG. 4.

FIG. 5 is an illustration of yet another advantageous embodiment of the present invention similar to that described in connection with FIG. 4 but further including return flux director 62. Return flux director 62 is constructed and operates similar to flux director 60 in that applied magnetic flux is gathered and channeled as desired. In this case, magnetic flux is directed back to second attractive component 22. Return flux director 62 has a tendency to increase the magnetic field strength between switch assembly 20 and second attractive component 22. This increased field strength further desensitizes the assembly 20 to the composition of first member 12 and second member 14. In addition, misalignment problems are further reduced, and the operational gap is increased.

Figure 5A:
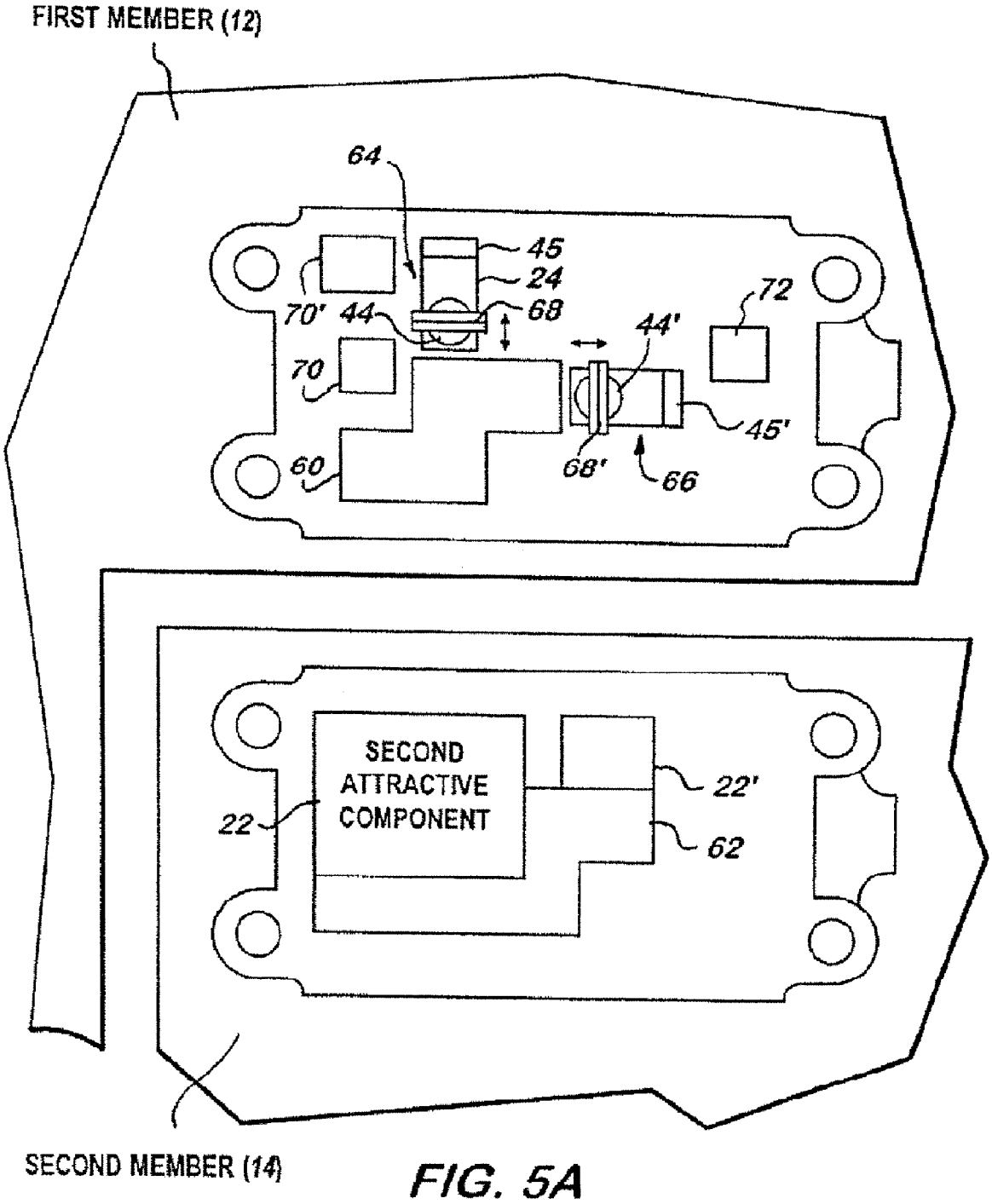
FIG. 5A is a block diagram illustrating another advantageous embodiment of the present invention according to FIG. 5.

FIG. 5A is an alternative embodiment according to FIG. 5 in which another second attractive component 22' is positioned adjacent to the return flux director 62. Providing another second attractive component 22' opposite in polarity to second attractive component 22 allows the magnetic circuit to close more tightly, increasing the flow of magnetic flux through the circuit. This in turn allows the distance between the members to be increased while maintaining a high level of circuit performance.

Figure 5B:
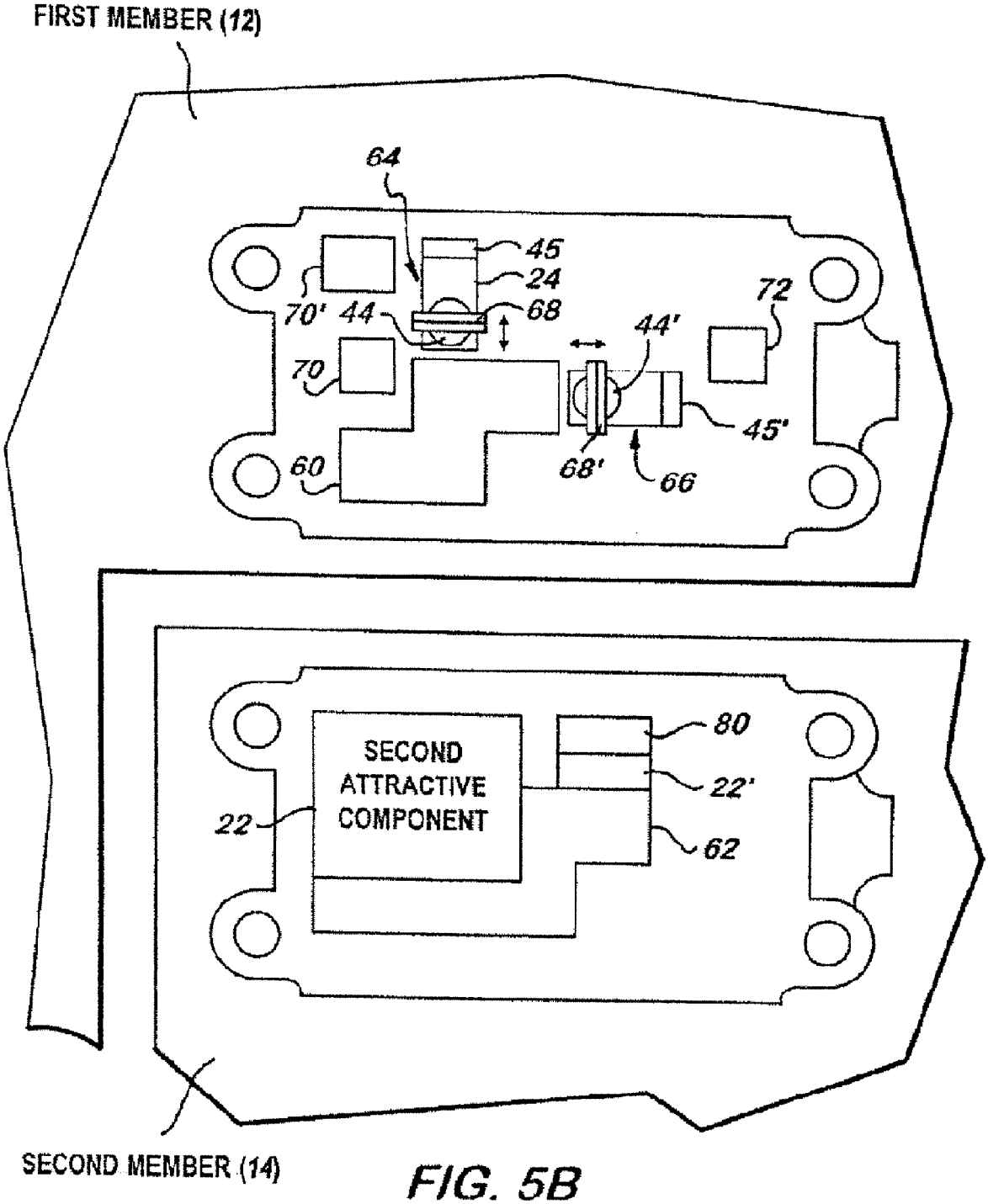
FIG. 5B is a block diagram illustrating yet another advantageous embodiment of the present invention according to FIG. 5.

FIG. 5B illustrates still another advantageous embodiment of the present invention, which is similar to that show in FIG.

5A, but further includes shim(s) 80 that may be used with and/or position adjacent to second attractive component 22'. The shim material of shim may comprise in one advantageous embodiment, a material having relatively good permeability and high saturation characteristics, including for example the material of the bias rings. While the shim(s) 80 is shown as only adjacent to second attractive component 22', it is contemplated that shim(s) 80 could extend across both second attractive component 22 and 22'.

While shim(s) 80 and second attractive component 22' are shown with the component located on the second member 14, it is contemplated that they may further be located with the parts located on first member 12 or in both locations.

It is still further contemplated that the switch and/or magnet assembly 20 may be provided with a metal back plate(s) 74 for compensation purposes. Also, high permeability shims may be used in connection with second attractive component 22. The shim material of shim may comprise in one advantageous embodiment, that of bias rings or other high permeability material.

Figure 6:
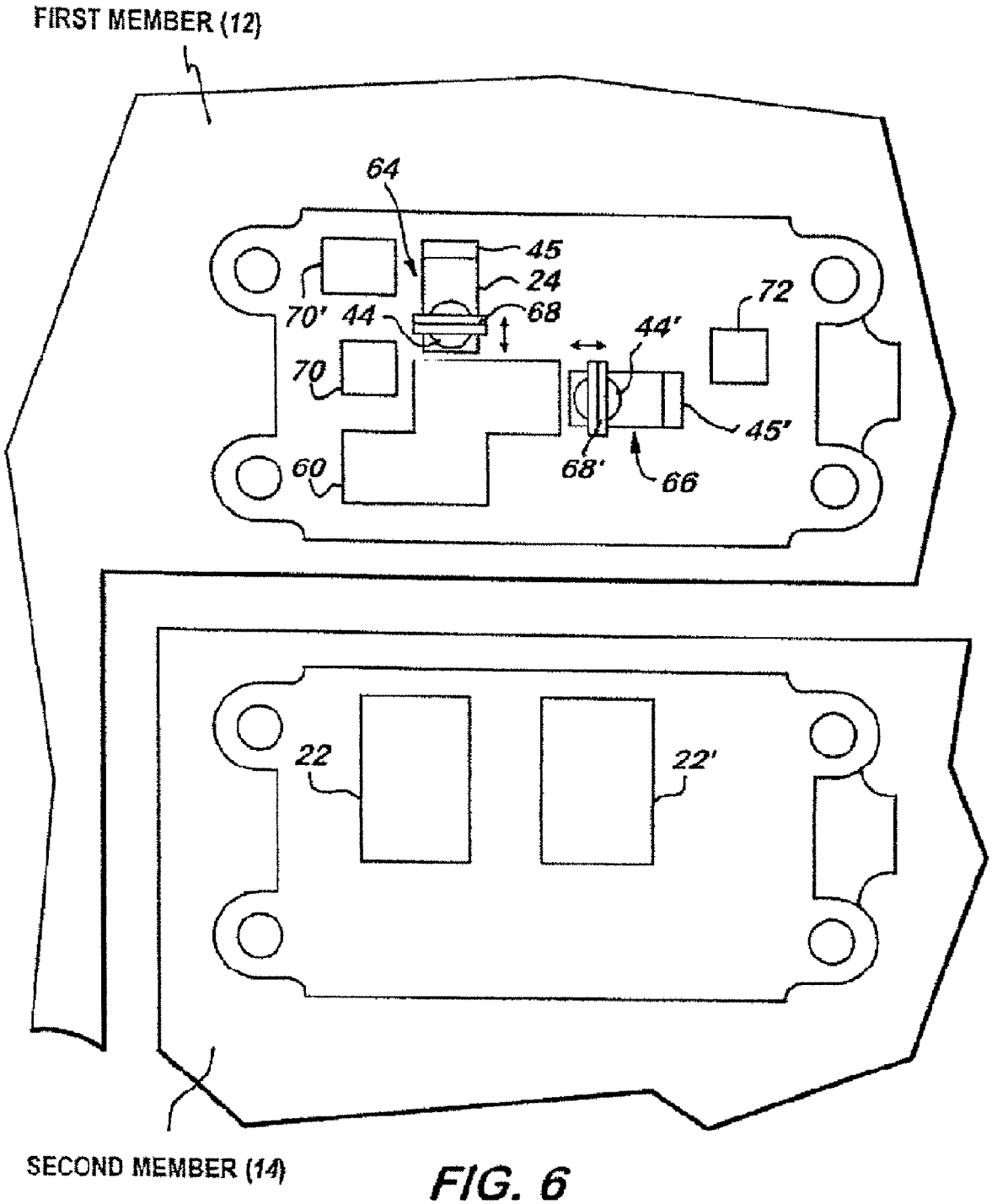
FIG. 6 is a block diagram of another advantageous embodiment of the present invention according to FIG. 4.

FIG. 6 is yet another illustration of an advantageous embodiment of the present invention including flux director 60 and two second attractive components 22, 22' positioned in second member 14. This embodiment again provides an increased magnetic field strength between the first and second members. It is also contemplated that the two second attractive components 22, 22' may be installed having opposite polarity at each end of switch assembly 20. It is also contemplated that many of these embodiments may be effectively used together in various combinations to increase overall system performance and repeatability as desired for a given application.

Figure 6A:
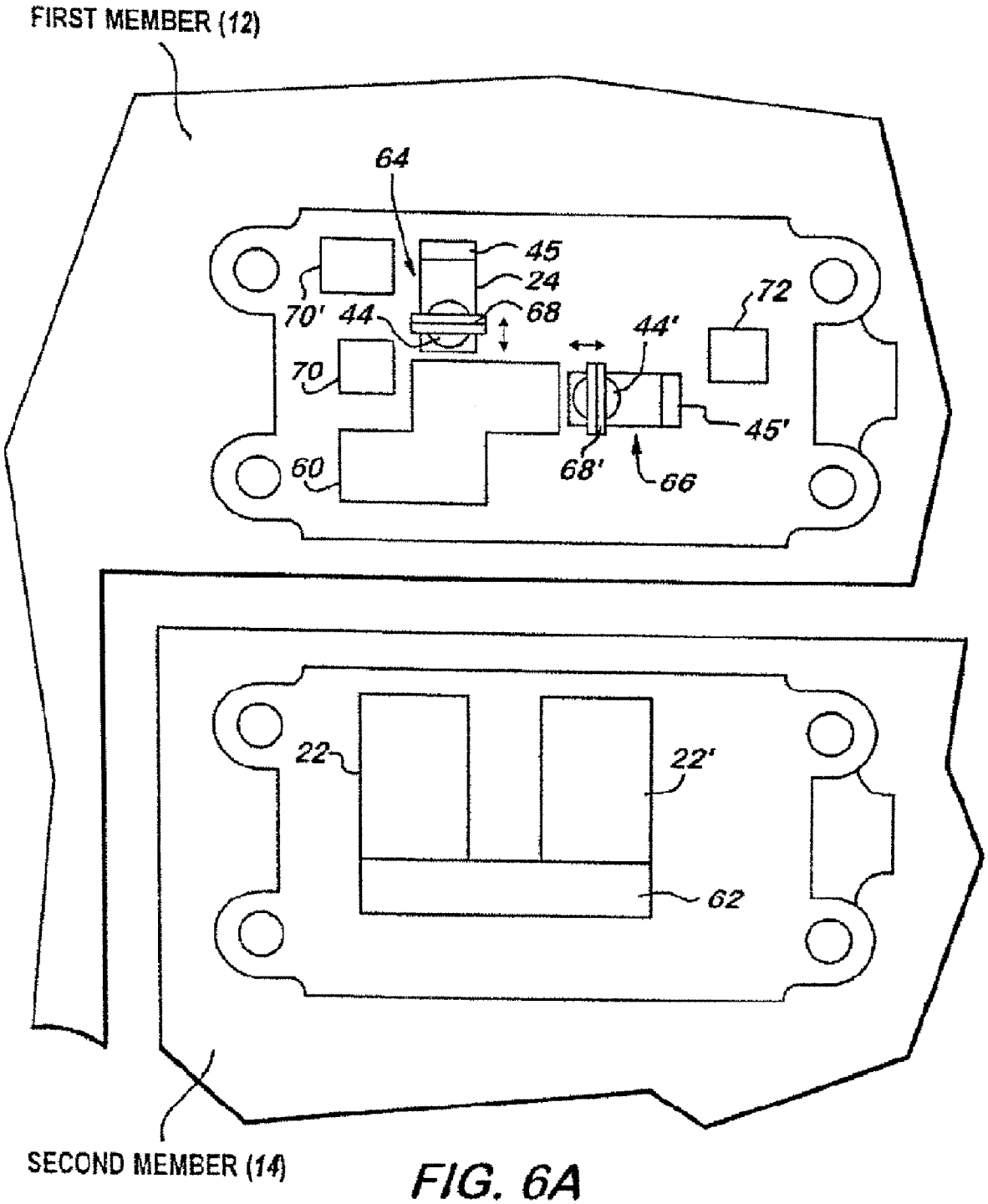
FIG. 6A is a block diagram of still another advantageous embodiment of the present invention according to FIG. 6.

FIG. 6A is still another advantageous embodiment of the present invention including two second attractive components 22, 22' and return flux director 62 provided in the shape of a rectangular bar located below the two second attractive components 22, 22'. Again the two second attractive components 22, 22' are provided as opposite polarity magnets and the optional return flux director 62 further increases flow of magnetic flux in the circuit increasing system performance and allowing the distance between the members to be increased if necessary.

Figure 7:
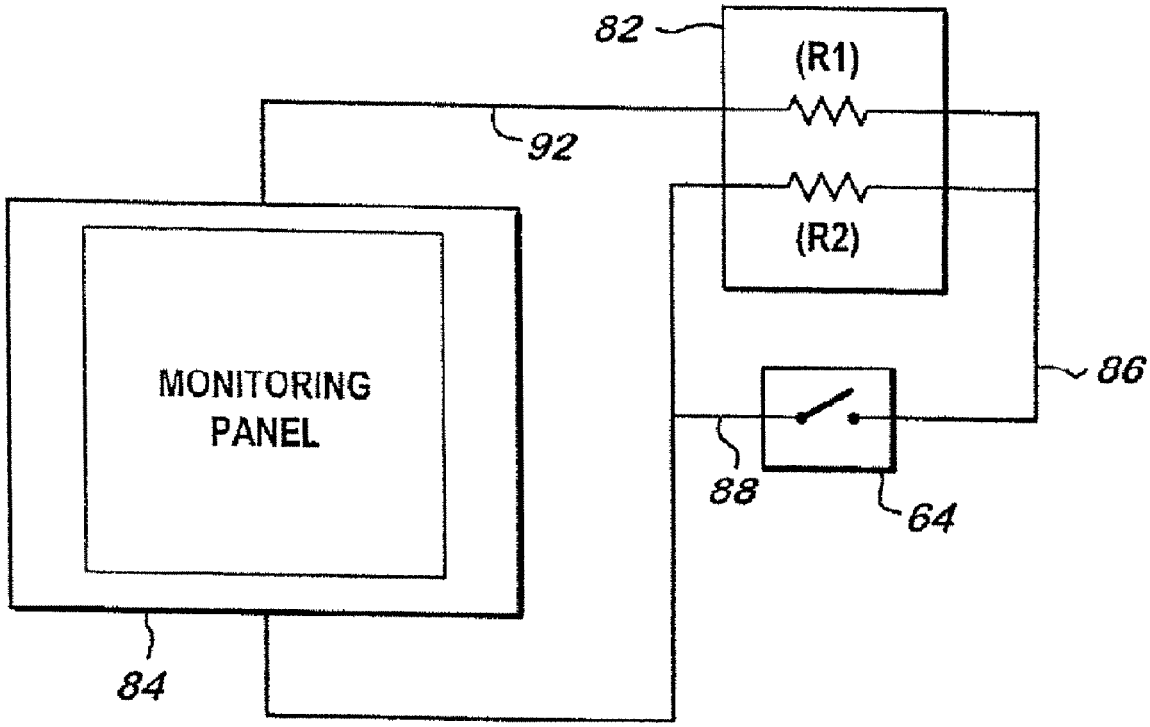
FIG. 7 is a schematic illustrating the positioning of a resistor network in the switch assembly.

FIG. 7 is an illustration of one particularly advantageous embodiment which includes the internal resistor network 82 according to the various embodiments previously described herein. Typically it has been standard practice in industry to terminate the electrical leads (86, 88) that are connected to a door switch 64 with resistors (R1) and (R2) at a monitoring panel 84 for the alarm system. When for example, the unit is in the secure position the door switch 64 is closed and the resistance at the monitoring panel 84 may equal (R1). When however, the unit is not secure the door contact is open and the total resistance at the monitoring panel 84 will then be equal to (R1)+(R2). Without resistor the indicated resistance is either 0 Ω (secure) or infinite Ω (not secure). Again, it is contemplated that many differing switching logic configurations may be used. This configuration is merely provided as an example of one such configuration and is not meant to be a limitation on the invention.

A problem with this arrangement is here identified. If an intruder shorts the electrical leads (86, 88) somewhere along the path from the switch to the monitoring panel 84 the total resistance would always read 0 Ω. The monitoring panel 84 then would interpret this as the unit is constantly secure allowing an intruder to bypass the security. However, positioning the resistors (R1) and (R2) inside of the door switch unit eliminates the intruder's ability to bypass the system. This is because if the potential intruder where to short electrical leads (88, 92), rather than reading resistance (R1) or "secure", the system will read 0 Ω or fault, which can activate an alarm condition.

Other benefits of this arrangements is that it eliminates the additional labor costs associated with installing the resistors (R1) and (R2) in the control panel 84 as these are already factory installed in the device itself, and eliminates any potential error the installer may make in connecting the resistors (R1) and (R2) to the system.

It should further be noted that, even though the internal resistor network 82 is shown (FIG. 4) located with the components mounted to the first member 12, it may also be positioned adjacent to the components mounted to second member 14.

Figure 8:
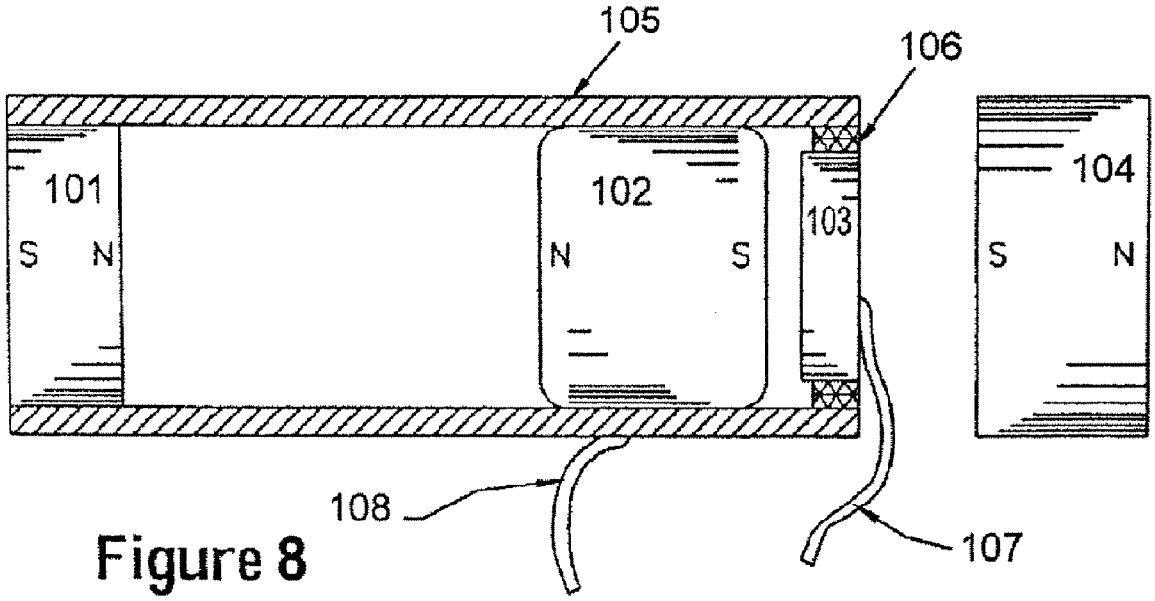
FIG. 8 is an illustration of another advantageous embodiment of the switch assembly according to FIG. 1.

Turning now to FIG. 8, an alternative embodiment of the switch arrangement is illustrated. For example, as seen in FIG. 8, a section view of a switch 100 actuated by a permanent magnet actuator 104 in the open circuit state according to the present invention is shown which includes a switch casing or tube 105 made of any electrically conducting non-magnetic material, for example, copper. A spring magnet 101, made from any permanent magnet material, is fixed to the tube 105. An electrical contact 103, made of any suitable contact material that is non-magnetic, is attached to an electrical insulator 106, the electrical insulator being fixed to the tube 105. An electrical conductor 108 is electrically connected to tube 105. Another electrical conductor 107 is electrically connected to electrical contact 103. The shiftable contact body 102, made from any conducting permanent magnet material, is in electrical contact with tube 105.

When the actuator magnet 104 is sufficiently removed from the proximity of the shiftable contact body 102, the shiftable contact body 102 is repelled by the opposing forces between the spring magnet 101 and the shiftable contact body 102 due to the predisposition of their like poles as shown and forced to abut electrical contact 103 resulting in a closed circuit between electrical contact 103 and tube 105. The actuator 104, when sufficiently proximate to the shiftable contact body 102, over powers, by repulsion, the influence of the spring magnet 101 on the shiftable contact body 102 causing it to travel away from the electrical contact 103, due to the predisposition of the like poles, resulting in an open circuit as illustrated. The predetermined distance between the spring magnet 101 and the shiftable contact body 102 in combination with the magnetic properties of the spring magnet 101, the shiftable contact body 102, and the actuator 104, sets the maximum actuation distance between the shiftable contact body 102 and the actuator 104.

It should be noted that, while the shiftable contact body 102 is described and shown in FIG. 8 as comprising a magnetic body, it is further contemplated that shiftable contact body 102 may comprise a magnetically susceptible material such as steel. In this instance, attractive forces of actuator 104 would cause shiftable contact body 102 to be drawn towards actuator 104 resulting in a closed circuit between electrical contact 103 and tube 105 when actuator 104 was proximate to shiftable contact body 102. In like manner, when actuator 104 was moved away from shiftable contact body 102, attractive forces generated by spring magnet 101 could drawn shiftable contact body 102 away from abutment with electrical contact 103 thereby causing an open circuit to occur between electrical contact 103 and tube 105. In this embodiment, it is contemplated that a spacer may effectively be positioned between spring magnet 101 and shiftable contact body 102 such that the shiftable contact body 102 will not come into contact with spring magnet 101.

Figure 9:
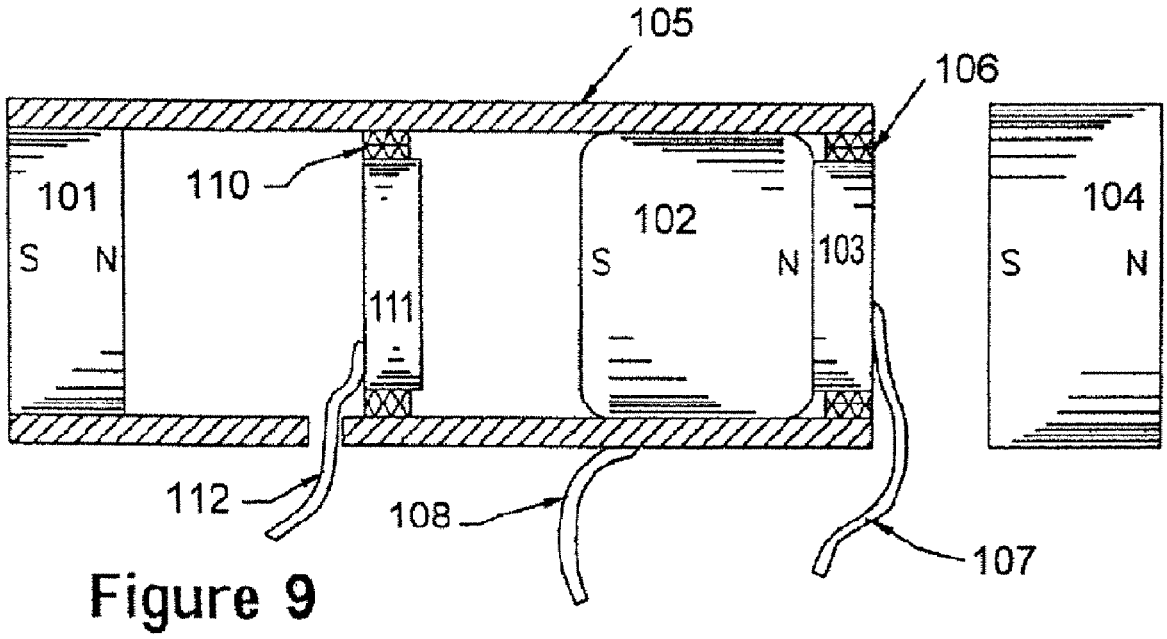
FIG. 9 is an illustration of still another advantageous embodiment of the switch assembly according to FIG. 8.

Referring to FIG. 9, a sectional view of switch 100 according to the present invention. The components and materials are similar to that described in connection with FIG. 8 and therefore will not be re-described here. As seen however, a second electrical contact 111 is provided located in tube 105. Electrical contact 111 is positioned within tube 105 between shiftable body 102 and spring magnet 101. Electrical contact 111 is mounted on insulator 110 such that it is electrically isolated from tube 105. Electrical conductor 112 is attached to electrical contact 111.

In this manner, shiftable body may be drawn into contact with electrical contact 103 when actuator 104 is proximate to shiftable contact body 102, and alternatively, is drawn into contact with electrical contact 111 by spring magnet 101 when actuator 104 is moved away from shiftable contact body 102. It is further contemplated that the magnetic poles may be reversed on shiftable contact body 102, as illustrated in FIG. 8, such that shiftable contact body is alternately repelled from actuator 104 and spring magnet 101 as per FIG. 8.

It is still further contemplated that shiftable contact body 102 does not have to comprise a magnetized component, but further may comprise a magnetically susceptible material, such as for example, steel.

Figure 10:
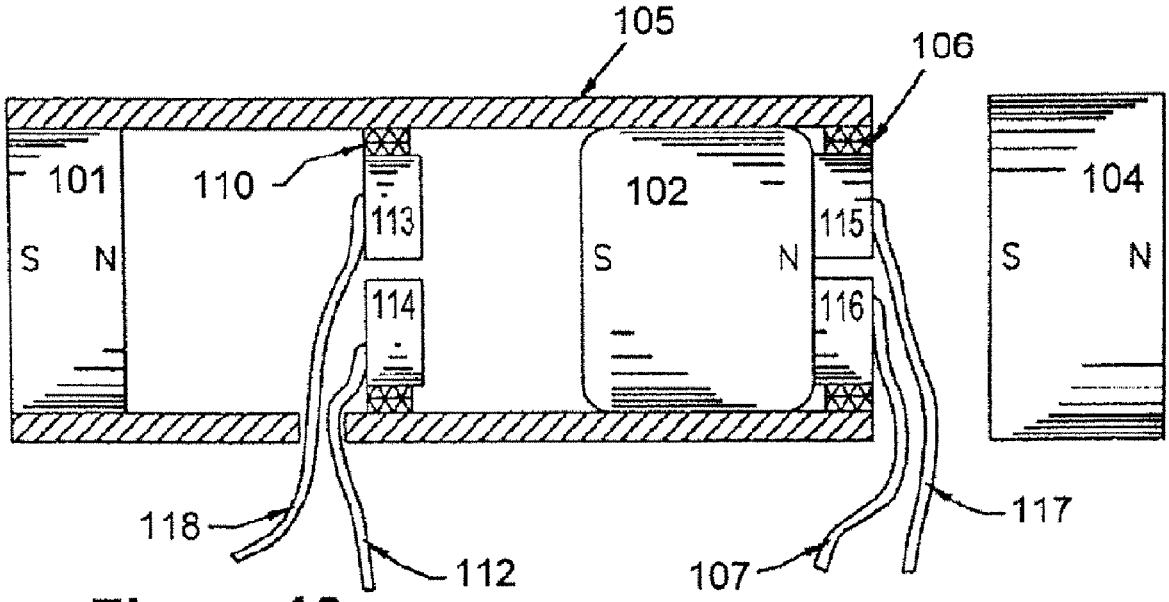
FIG. 10 is an illustration of yet another advantageous embodiment of the switch assembly according to FIG. 8.

Referring now to FIG. 10, still another embodiment of switch 100 is illustrated. In this particular configuration, tube 105 may be provided as an insulating material, while electrical contacts 113, 114 and electrical contacts 115, 116 are provided. Electrical contacts 113, 114 are mounted on insulator 110 and are provided with electrical conductors 118, 112 respectively. Electrical contacts 115, 116 are mounted on insulator 106 and are provided with electrical conductors 117, 107 respectively.

Operation of the switch 100 is similar to that described in connection with FIG. 9. In this particular arrangement however, the electrical switch is closed between electrical contacts 113, 114 when shiftable contact body 102 is drawn towards spring magnet 119. Alternatively, the electrical switch is closed between electrical contact 115, 116 when shiftable contact body 102 is drawn towards actuator 104.

The switch 100 variously illustrated in FIGS. 8-10 may be used as a variation of the switch configuration illustrated in FIG. 1. It is therefore contemplated that switch 100 may effectively be used with, for example, flux director or concentrator 60 and utilized as previously discussed in connection with FIGS. 4-7.

Figure 11:
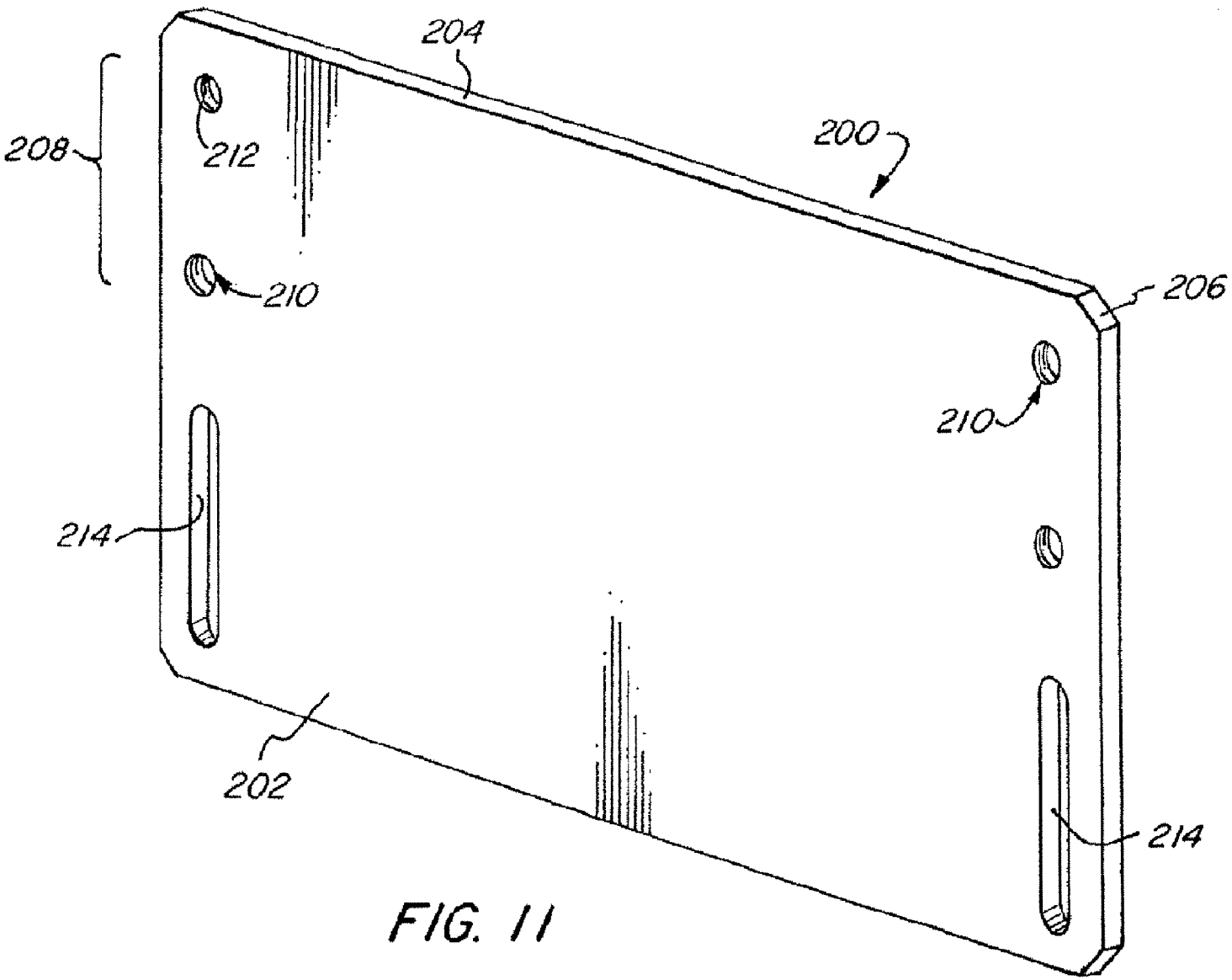
FIG. 11 is an illustration of a mounting bracket for use with the magnetic switch according to FIG. 1.

Referring now to FIG. 11, mounting bracket 200 is illustrated for use with switch 100. In this advantageous embodiment, bracket 200 includes a substantially flat body portion 202 having an edge 204 with a thickness (t), which may be formed as a rectangular shape as indicated. Alternatively, it is contemplated that body portion 202 may be formed in virtually any shape as desired. Body portion 202 may be formed from a robust material such as a metal or alloy or even a rigid plastic. Also illustrated in FIG. 11 are chamfered corners 206.

Body portion 202 is further illustrated having mounting element 208, which in this particular embodiment comprises mounting holes 210. There are four mounting holes 210 illustrated in FIG. 11, however, it is contemplated that any number may be provided. Additionally, mounting holes 210 are provided with threading 212 for receiving a screw or bolt (not shown) therein. In this manner, switch 100 may effectively be affixed to bracket 200 as illustrated in FIG. 12.

Figure 12:
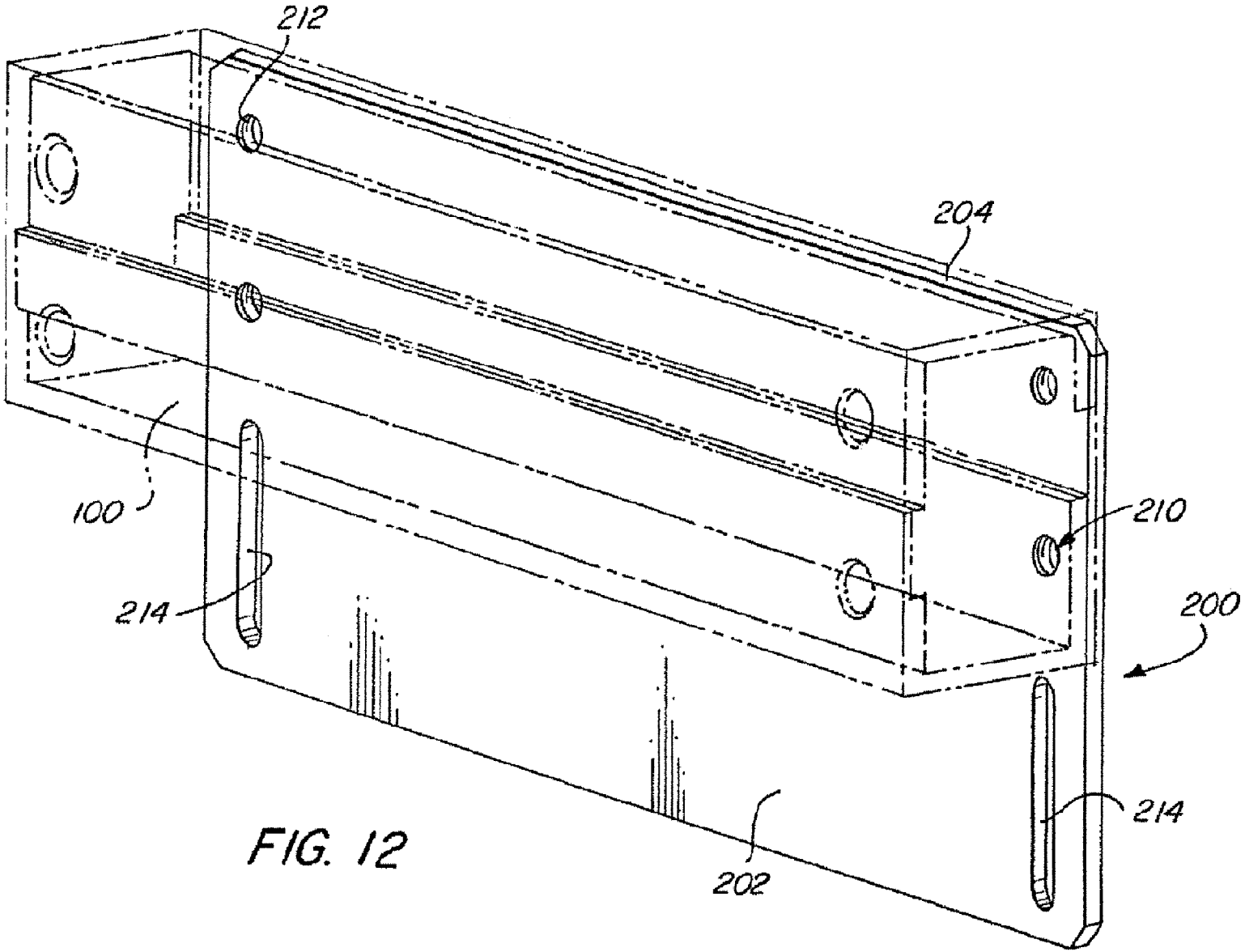
FIG. 12 is an illustration of the magnetic switch of FIG. 1 affixed to a mounting bracket of FIG. 11.

Also illustrated in FIGS. 11-12 are slots 214, which are formed as elongated channels extending through body portion 202 as shown. Slots 214 are provided to receive mounting bolts or screws (not shown) therein to affix the bracket 200 to a first member, which may comprise door 14 (FIG. 1). In this manner, if door 14 sags over time with respect to doorframe 12 thereby increasing an operational gap of switch 100, the mounting screws or bolts passing through slots 214 may be loosened, the bracket slid upward relative to doorframe 12, and the screws and bolts retightened to hold the bracket in the new location. In this manner, the operational gap (g) 226 (FIG. 15) may be adjusted relatively quickly without causing damage to the door 14.

As can be seen from FIG. 12, switch 100 may quickly and easily be attached to bracket 200 with mounting holes 210. Bracket 200 therefore is positioned on a surface of door 14, which is essentially flush with a surface of doorframe 12. The slots 214 providing a convenient means for adjusting the position of the bracket on the surface of door 14.

Figure 13:
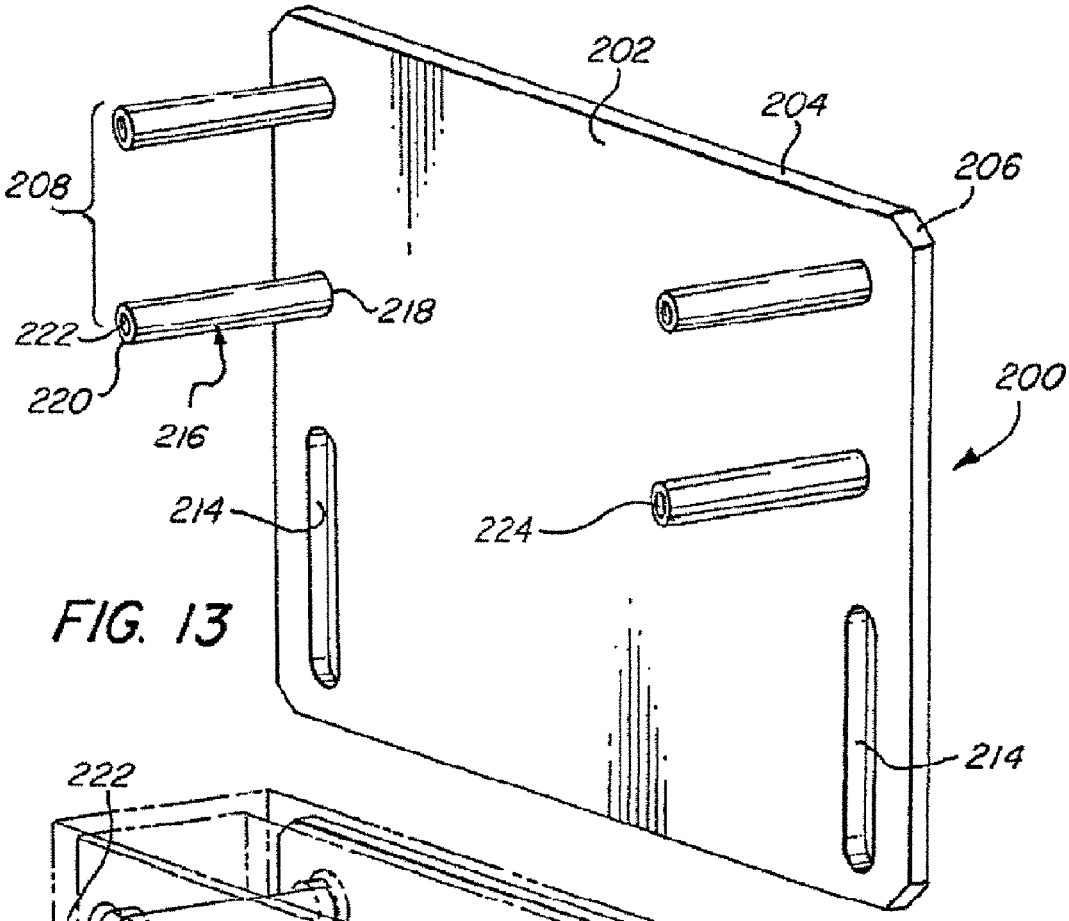
FIG. 13 is another illustration of the mounting bracket for use with the magnetic switch according to FIG. 1.
Figure 14:
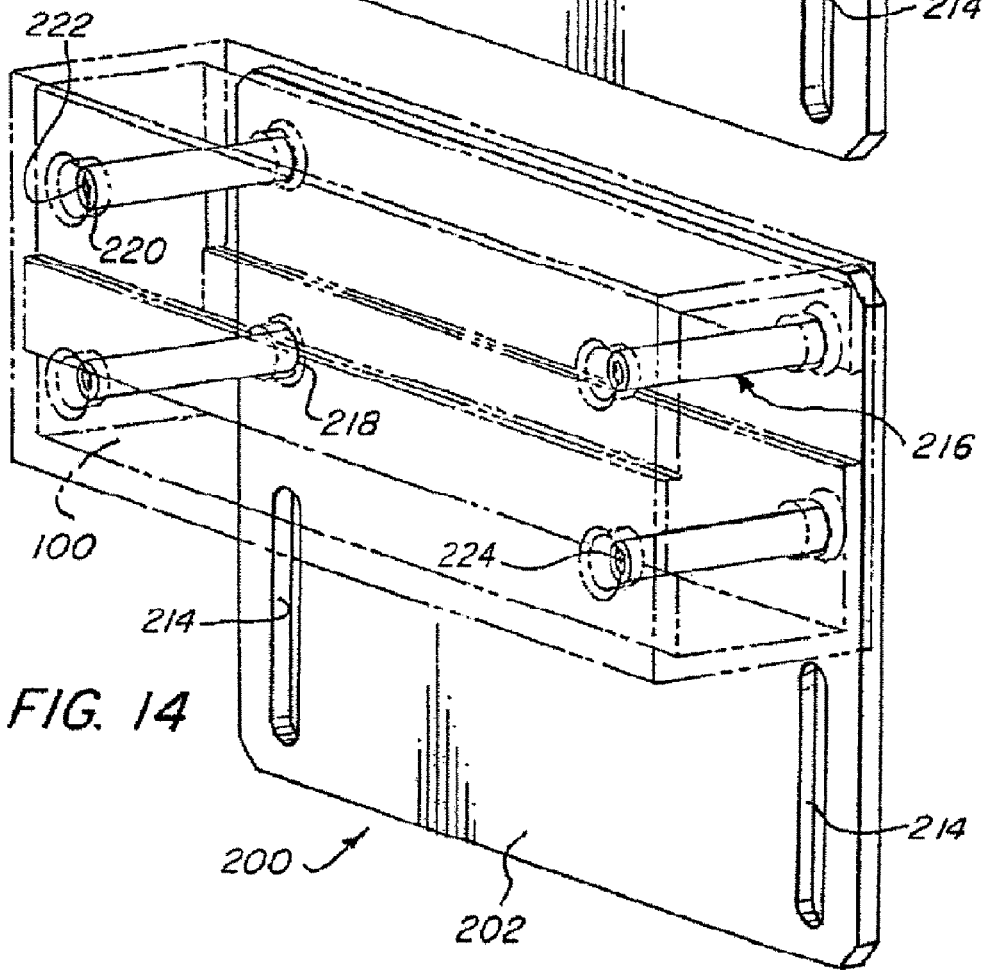
FIG. 14 is an illustration of the magnetic switch of FIG. 1 affixed to a mounting bracket of FIG. 13.

Turning now to FIGS. 13 and 14, an alternative embodiment of bracket 200 is shown. Bracket 200 is similar to that depicted in FIG. 11 except that mounting element 208 comprises mounting studs 216, in which four are illustrated in this embodiment. Mounting studs 216 comprise a proximal end 218 affixed to body portion 202 and a distal end 220. Distal end 220 may further be provided with a hole 222 including threading 224 for receiving a screw or bolt therein. In this manner, as seen in FIG. 14, switch 100 may be fitted over mounting studs 216 and screws (not shown) may engage with threading 224 through a cover of the switch 100.

In this particular embodiment it is contemplated that thickness (t) may be provided as a smaller dimension as any threading provided to engage with a screw is provided in the mounting studs 216 and not in body portion 202.

Figure 15:
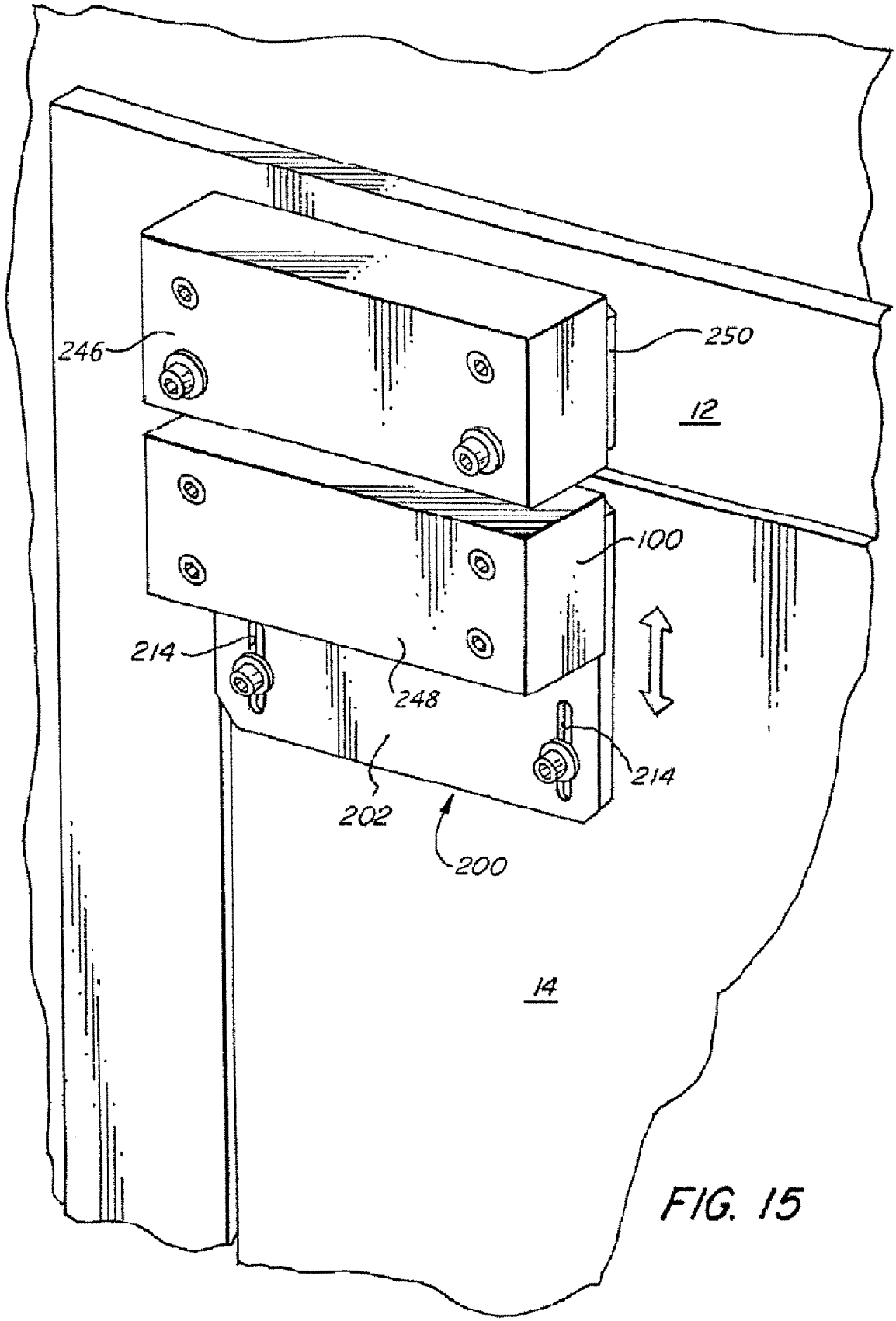
FIG. 15 is an illustration of the magnetic switch assembly installed with the bracket on a doorway.

FIG. 15 depicts the magnetic system mounted to a door 14 and doorframe 12. As can be seen, the operational gap (g) 226 may be variously adjusted by loosening the bolts in slots 214 and sliding bracket 202 upward on the face of door 14. In this manner, any sagging of the door 14 relative to doorframe 12 may be compensated for and operational gap (g) 226 may remain optimal for system performance.

Also illustrated in FIG. 15 is spacer 250, which is provided for mounting of one of the parts against the doorframe 12. Typically, an actuator 248 will be mounted on bracket 200, while a switch assembly 246 will be mounted on the spacer 250, however, this is not required.

While mounting bracket 200 has been illustrated used in connection with switch 100, it is contemplated that bracket 200 may effectively be used with virtually any type of security device that may be mounted to a door and/or a door frame. The advantage of the bracket 200 configuration is that it allows the adjustment of the security device(s) after mounting to the door, which allows the testing to determine the most effective and sensitive range for the device(s) to be mounted to the door and/or doorframe.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A bracket assembly for mounting a magnetic switching system to a member, the assembly comprising:

a first magnetic switch part mounted to a first member;

a second magnetic switch part;

a bracket mounted to a second member to form an operational gap between the first and the second members, said bracket having:

a substantially flat body;

a mounting element attaching said second magnetic switch part to said substantially flat body; and at least two substantially parallel slots extending through said substantially flat body portion, said slots extending perpendicular to the operational gap such that the size of the operational gap may be adjusted;

wherein the second member is moveable relative to the first member.

2. The bracket assembly according to claim 1 wherein the mounting element comprises spaced apart threaded mounting holes extending through the substantially flat body.

3. The bracket assembly according to claim 1 wherein the mounting element comprises at least one mounting stud for mounting of said second magnetic switch part to said bracket.

4. The bracket assembly according to claim 3 wherein the at least one mounting stud comprises a distal end and a proximal end, the mounting stud having the proximal end attached to the substantially flat body and the distal end is provided with a threaded hole positioned therein.

5. The bracket assembly according to claim 1 wherein the first and second members are provided substantially flush with respect to each other, and said bracket and the first magnetic part are positioned on a surface of the first and second members respectively.

6. The bracket assembly according to claim 1 further comprising a spacer for attaching the first magnetic switch part to the first member.

7. The bracket assembly according to claim 6 wherein said spacer has a thickness that is approximately equal to a thickness of said bracket.

8. A bracket assembly for mounting a magnetic switching system to a member, the assembly comprising:

a first magnetic switch part mounted to a first member;

a second magnetic switch part mounted to a bracket, the bracket mounted to a second member forming an operational gap between the first and second members, wherein the bracket has:

a substantially flat body; and at least two substantially parallel slots extending through said substantially flat body portion;

wherein the second member is moveable relative to the first member.

9. The bracket assembly according to claim 8 wherein said slots extend perpendicular to the operational gap such that the size of the operational gap may be adjusted.

10. The bracket assembly according to claim 8 wherein said second magnetic switch part is mounted to said bracket by a mounting element that comprises spaced apart threaded mounting holes extending through the substantially flat body.

11. The bracket assembly according to claim 8 wherein said second magnetic switch part is mounted to said bracket by a mounting element that comprises at least one mounting stud for mounting of said second magnetic switch part to said bracket.

12. The bracket assembly according to claim 8 wherein the first and second members are provided substantially flush with respect to each other, and said bracket and the first magnetic part are positioned on a surface of the first and second members respectively.

13. The bracket assembly according to claim 8 further comprising a spacer for attaching the first magnetic switch part to the first member.

14. The bracket assembly according to claim 13 wherein said spacer has a thickness that is approximately equal to a thickness of said bracket.

15. A bracket assembly for mounting a magnetic switching system to a member, the assembly comprising:

a first switch enclosure for mounting to a first member;

a second switch enclosure for mounting to a second member;

a movement switch that switches between open and closed contact positions indicating when a first and a second member are in proximity to each other, the movement switch including a first movement switch part mounted in said first switch enclosure and a second movement switch part mounted in said second switch enclosure;

a bracket affixable to said first member, said first switch enclosure positioned on said bracket;

a pry tamper switch that switches between first and second contact positions indicating when said first switch enclosure and said first member are in proximity to each other;

said pry tamper switch including a first magnetic member biasing a shiftable body to the first contact position when said first switch enclosure and said first member are in proximity to each other, and said pry tamper switch including a second magnetic member biasing the shiftable body to the second contact position when said first switch enclosure and said first member are not in proximity to each other.

16. The bracket assembly according to claim 15 wherein said bracket comprises a substantially flat body having at least two elongated slots extending therethrough.

17. The bracket assembly according to claim 16 wherein the at least two elongated slots are parallel to each other.

18. The bracket assembly according to claim 15 further including a biasing member comprising a bias ring.

* * * * *